United States Patent [19]

Meister

[11] Patent Number: 4,750,996

[45] **Date of Patent: * Jun. 14, 1988**

[54] GATED DRAWER FILTER

[75] Inventor: Richard P. Meister, Newton, Kans.

[73] Assignee: Bunting Magnetics Company, Newton, Kans.

[ * ] Notice: The portion of the term of this patent subsequent to Nov. 4, 2003 has been disclaimed.

[21] Appl. No.: 858,802

[22] Filed: May 2, 1986

Related U.S. Application Data

[63] Continuation-in-part of Ser. No. 631,257, Jul. 16, 1984, Pat. No. 4,620,923.

[51] Int. Cl.[4] ..... B03C 1/26

[52] U.S. Cl. ..... 209/223.1; 210/95; 210/222

[58] Field of Search ..... 209/38, 39, 40, 212, 209/213, 222, 223 R, 223 A, 224, 478; 210/94, 95, 222, 223; 209/223.1, 223.2

[56] References Cited

U.S. PATENT DOCUMENTS

| | | | |
|---|---|---|---|
| 2,830,705 | 4/1958 | Johannesen | 210/222 |
| 2,912,106 | 11/1959 | Martin, Jr. | 210/222 |
| 3,160,583 | 12/1964 | Stem | 209/223 R |
| 4,144,012 | 3/1979 | Pinkley | 209/223 R |
| 4,340,470 | 7/1982 | Van Mol | 210/94 |
| 4,457,838 | 7/1984 | Carr | 209/223 A |
| 4,620,923 | 11/1986 | Meister | 210/222 X |

*Primary Examiner*—Richard V. Fisher
*Assistant Examiner*—W. Gary Jones
*Attorney, Agent, or Firm*—John Wade Carpenter

[57] ABSTRACT

A drawer filter having a housing which includes a top flange with an opening and a bottom flange with an opening in communication with the opening of the top flange. A magnetic filter slidably lodges within the housing in communication with the opening of the top flange and the opening of the bottom flange in order to filter magnetically any particulate matter passing through the top and the bottom opening. A gate valve slidably lodges within the housing between the opening in the top flange and the magnetic filter in order to control the flow of particulate matter through and between the opening in the top flange and the opening in the bottom flange.

19 Claims, 3 Drawing Sheets

FIG. 1
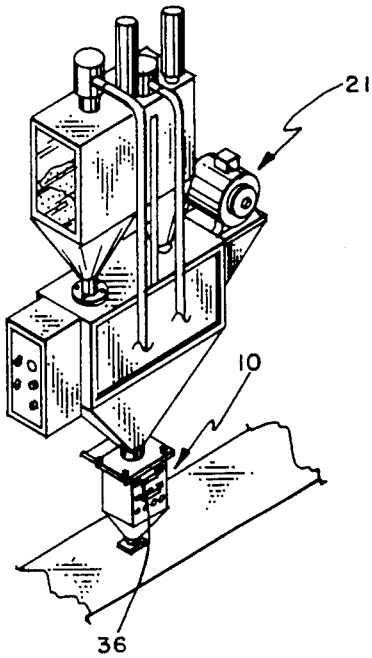
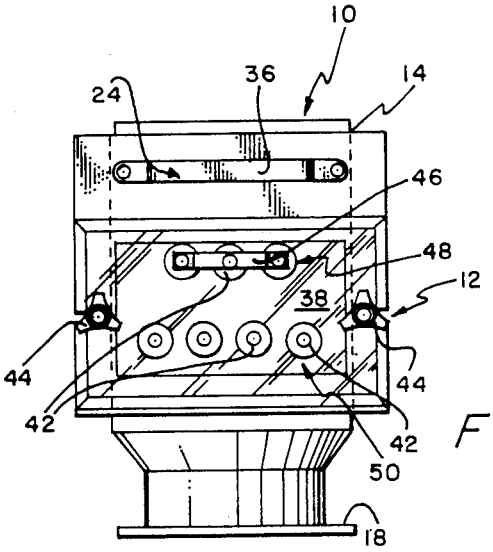
FIG. 2
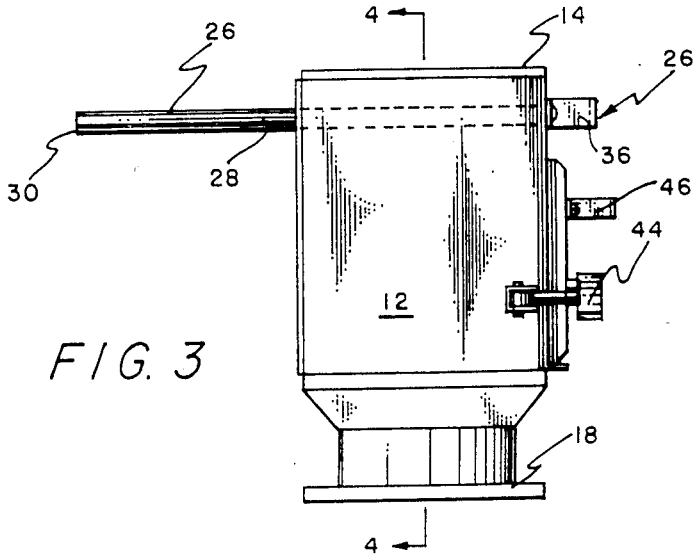
FIG. 3

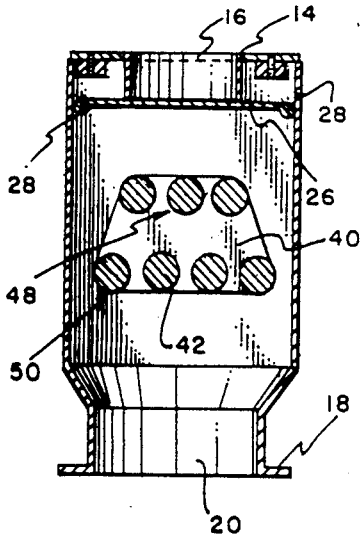
FIG. 4
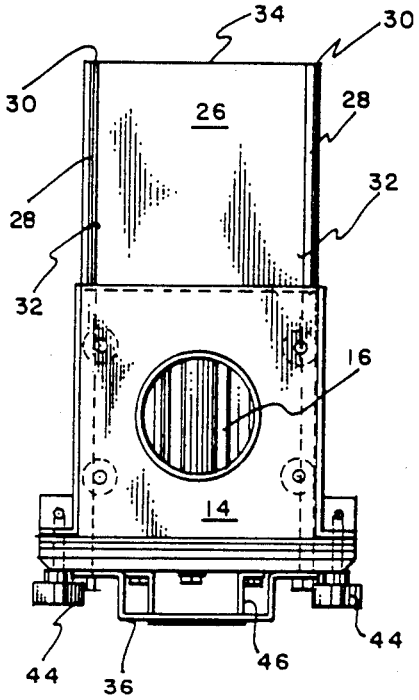
FIG. 5
FIG. 6
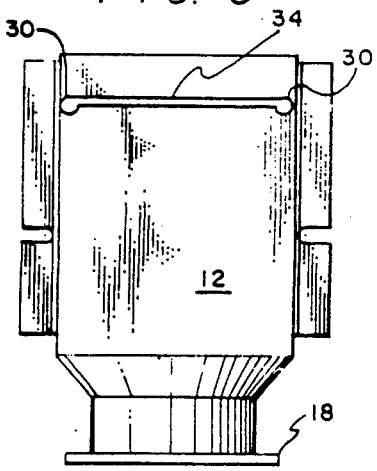
FIG. 7
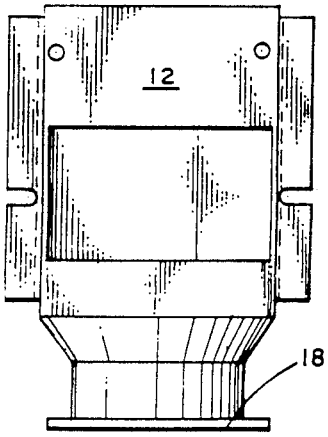

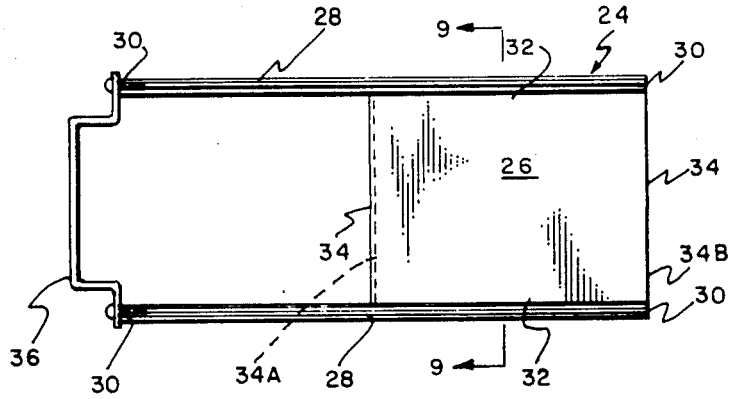
FIG. 8
FIG. 9
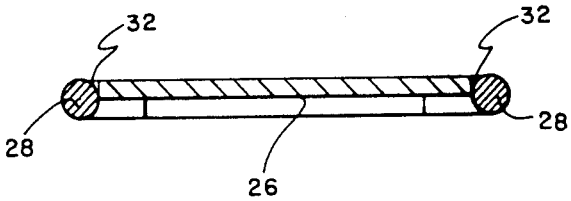
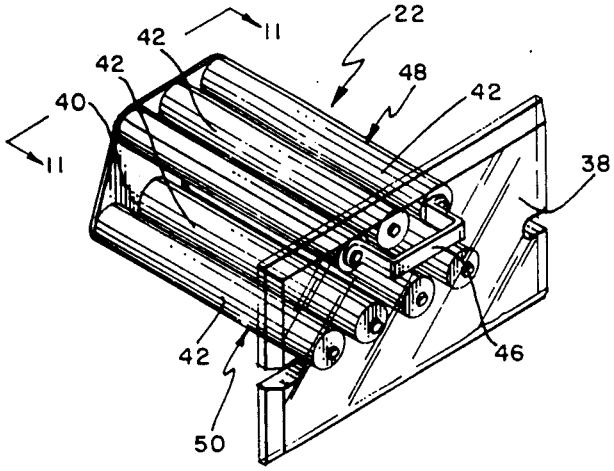
FIG. 10
FIG. 11
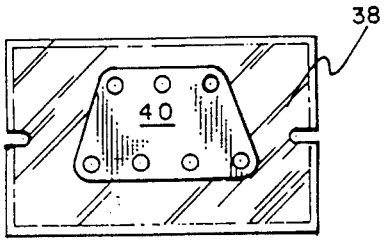

GATED DRAWER FILTER

BACKGROUND OF THE INVENTION

This is a continuation-in-part application of my copending application filed July 16, 1984 and having Ser. No. 631,257 now U.S. Pat. No. 4,620,923.

1. Field of the Invention

This invention provides a gated drawer filter. More specifically, this invention contemplates a novel drawer filter that employs a novel gate valve slidably disposed within the housing of the drawer filter.

2. Description of the Prior Art

U.S. Pat. No. 2,912,106 by Martin, Jr., teaches a magnetic filter that has a slide gate for closing the passage through the filter. U.S. Pat. No. 4,144,012 by Pinkley discloses a slide gate which cuts off the flow of material through a hopper. Pinkley discloses a pair of support plates which hold magnets. Pinkley's support plates do not form any part of the housing sides. Pinkley does not teach or suggest at least one rod passing through the same box-like housing wherethrough a magnetic filtering means and a gate valve pass. U.S. Pat. No. 3,160,583 to Stem discloses a plurality of magnetic grates arranged in superimposed tiers. U.S. Pat. No. 4,340,470 to Van Mol teaches a liquid filter manufactured of transparent material, such as synthetic plastic or glass, so that the condition of the filter element is readily viewed. None of the foregoing prior art patents teach or suggest the particular drawer filter of this invention.

SUMMARY OF THE INVENTION

This invention accomplishes its desired objects by providing a novel drawer filter comprising in combination a housing means having a top flange opening and a bottom flange opening in communication with the top flange opening. A magnetic filtering means slidably lodges within the housing means in communication with the top flange opening and the bottom flange opening in order to filter magnetically any particulate matter, or the like, passing through the top flange opening and the bottom flange opening. A gate valve means is slidably disposed within the housing means between the top flange opening and the magnetic filtering means in order to control the flow of particulate matter through and between the top flange opening and the bottom flange opening. The gate valve means comprises a valve plate means having a horizontal planar surface. At least one rod means is secured to the valve plate means and is slidably disposed through the housing means and is adapted to move the valve plate means.

It is therefore an object of this invention to provide a novel drawer filter.

Still further objects of this invention reside in the provision of a drawer filter which includes a novel gate valve and which is relatively inexpensive to manufacture.

These together, with the various ancillary objects and features, will become apparent as the following description proceeds, are attained by this invention, preferred embodiments being shown in the accompanying drawings, by way of example only, wherein:

BRIEF DESCRIPTION OF THE DRAWINGS

FIG. 1 is a perspective view of the gated drawer filter including a particulate feeder disposed on top thereof;

FIG. 2 is a front elevational view of the drawer filter;

FIG. 3 is a side elevational view of the drawer filter with the novel gate valve in an open position;

FIG. 4 is a vertical sectional view taken in direction of the arrows and along the plane of line 4—4 in FIG. 3;

FIG. 5 is a top plan view of the drawer filter with the gate valve in an open position;

FIG. 6 is a back elevational view of the drawer filter with the gate valve in an open position;

FIG. 7 is a front elevational view of the gate filter with the magnetic filters removed;

FIG. 8 is a top plane view of the novel gate valve;

FIG. 9 is a vertical sectional view taken in direction of the arrows and along the plane of line 9—9 of FIG. 8;

FIG. 10 is a perspective view of the magnetic filters for the drawer filter; and FIG. 11 is a back elevational view of the magnetic filters taken in direction of the arrows and along the plane of line 11—11 in FIG. 10.

DETAILED DESCRIPTION OF THE INVENTION

Referring in detail now to the drawings wherein like reference numerals indicate similar parts of the invention, there is seen a drawer filter, generally illustrated as 10, having a housing, generally illustrated as 12, which includes a top flange 14 with a top flange opening 16 and a bottom flange 18 with a bottom flange opening 20 that is in communication with the top flange opening 16. In a preferred embodiment of the invention, housing 12 defines generally a rectangular (or square) box-like structure with three solid housing sides and a front side having a front opening, as illustrated in the drawings. A particulate feeder means, generally illustrated as 21, is supported by the top flange 14. A magnetic filtering means, generally illustrated by 22 (see FIG. 10), is slidably lodged within the housing 12 through the front opening and is in communication with the top flange opening 16 and the bottom flange opening 20 in order to filter magnetically any particulate matter, or the like, passing through the top flange opening 16 and the bottom flange opening 20. A gate valve means, generally illustrated as 24, is slidably disposed within the housing 12 between the top flange opening 16 and the magnetic filtering means 22 in order to control the flow of particulate matter through and between the top flange opening 16, the magnetic filtering means 22, and the bottom flange opening 20.

The gate valve means 24 comprises a valve plate 26 having a horizontal planar surface. At least one rod means 28 is secured to the valve plate 26 and is slidably disposed through the housing 12 and is adapted to move the valve plate 26. In a more preferred embodiment of the invention as illustrated in the drawings, the valve plate 26 has a pair of rods 28—28, each which include two ends 30—30. The valve plate 26 has a first pair of parallel sides 32—32 that attach to the pair of rods 28—28 such that the rods 28—28 are oppositely disposed and in a general parallel relationship with respect to each other. The valve plate 26 also has a second pair of parallel sides 34—34. As illustrated in FIGS. 4 and 9, the horizontal planar surface of the valve plate 26 registers tangentially with the circular rods 28—28 in the embodiment shown in the drawings. Such registration allows for ease of manufacturing and provides a recess for the weld securing the parts together. One of the pair of sides 34—34 has a beveled edge 34A, while the remaining side has an edge 34B (see FIG. 8) that registers with the end 30 of the pair of rods 28—28.

A gate handle 36 is secured to the remaining available end 30 of each of the pair of rods 28—28 for slidably moving the gate valve 24 within the housing 12 such that the gate plate 26 obstructs the top flange opening 16 as desired in order to control the flow therethrough.

While the more preferred embodiment of the invention has been illustrated in the drawings and described as having a pair of rods 28—28 oppositely disposed on parallel sides 32—32 of the valve plate 26, it should be understood that the spirit and scope of the invention encompasses one rod 28 having an end secured to an end or side of the valve plate 26 at approximately the center thereof (or any other location thereon) while the other end of the rod 28 extends through and pierces a housing side of housing 12. Such other end may possess a handle, or the like, for moving the valve plate 26 between the top flange opening 16 and the magnetic filtering means 22 for controlling the flow of particulate matter through and between the top flange opening 16, the magnetic filtering means 22 and the bottom flange opening 20. The one rod 28 embodiment would generally perform essentially the same function in essentially the same manner as the dual rod embodiment.

However, the single rod embodiment where a single rod 28 is connected to an end or side of the valve plate 26 at approximately the center thereof is distinctly inferior to the dual rod system due to the presence of the single rod 28 between the top flange opening 16 and the magnetic filtering means 22 when the valve plate 26 (or the gate valve means 24) is in an open position. Regardless of the superiority or inferiority of any particular number of rod(s) 28 employed, the spirit and scope of this invention contemplates and/or envisions one or more rod(s) 28.

The magnetic filtering means 22 comprises a transparent front plate 38 and a back plate 40. A plurality of magnetic cylinders 42 interconnect the transparent front plate 38 with the back plate 40. The magnetic filter 22 is secured within the box-like housing 12 by nuts 44—44, and a handle 46 is secured to the transparent front plate 38 to slide the magnetic filtering means 22 in and out of the box-like housing 12, such that the front plate 38 defines part of the front side of the box-like housing 12 when the magnetic filtering means 22 is disposed in an operative position within the box-like housing 12, as illustrated in FIGS. 1–7. Preferably, the front plate 38 and the back plate 40 are unitary with no holes, openings, apertures, or the like, communicating with the atmosphere (other than incidental ones such as where a bolt snugly passes to be mated with a nut, or the like, for connecting a magnetic cylinder 42 to one of the plates). When the front plate 38 has no openings such that the inside of the box-like housing 12 does not communicate with the outside atmosphere, no air or any other matter is allowed to enter or leave through the structure of the front plate 38. This prevents any material leaving the particulate feeder means 21 and entering the box-like housing 12 through the top flange opening 16 from being strewn outside of the box-like housing 12.

The plurality of magnetic cylinders 42 comprises a first magnetic row, generally illustrated as 48, and a second magnetic row, generally illustrated as 50, and parallelly disposed with respect to the first magnetic row 48. Of course, a single row or any plurality of rows can be used, as desired.

With continuing reference to the drawings for operation of the invention, particulate feeder means 21 feeds particulate matter (such as plastic pellets) through the top flange opening 16 of the top flange 14 in order that the magnetic filtering means 22 can remove any metallic objects commingled with the plastic pellets. The gate valve 24 enables the operator to restrict and control the flow through the flange opening 16 and is an improvement over the prior art because when the slide gate 24 is pulled into the box-like housing 12, no plastic pellets will be pulled out of the housing 12 and dumped on the equipment of floor. It is preferred that the edge 34A be beveled (as illustrated by the dotted line in FIG. 8) in order to facilitate the insertion of the valve gate 24 into the box-like housing 12 such that the valve plate 26 can restrict the flow of particulate matter through and between the top flange opening 16 and the bottom flange opening 20.

The cylindrical magnets 42 are positioned in rows 48 and 50 in order to provide more efficient filtering. The use of slidably disposed magnetic filtering means 22 allows constant magnetic protection because if the operator forgets to replace the magnetic filters 42, plastic pellets will flow out of the box-like housing 12 and onto the floor. The combination of the novel gate valve 24 with the magnetic filters means 22 enables the cylindrical magnets 42 to be easily purged without any plastic pellets falling on the equipment or floor.

When the operator looks through the transparent front plate 38 and sees that the magnetic filters 42 are substantially covered with metallic objects, the operator merely grasps the handle 36 of the gate valve 24 and pulls the handle towards the front in order that the valve plate 26 covers the entire top flange opening, as illustrated in FIG. 4. This prevents any further flow of plastic pellets through the top flange opening 16 and into the inside of the box-like housing 12.

The magnetic filtering means 22 may be easily removed by unscrewing the nuts 44—44 and grasping the handle 46 to slide the magnetic means 22 out of the box-like housing 12 in order that the magnetic cylinders 42 can be purged. Cleaning can be done within minutes and the particulate feeder means 21 does not have to be shut down. The ease of cleaning the magnetic filtering means 22 without spilling any of the plastic pellets enables cleaning to be easily and safely accomplished, with less downtime, and with less overall maintenance cost.

When the magnetic cylinders 42 have been purged, magnetic filtering means 22 is slid back into the box-like housing 12 and secured in place by fastening nut 44—44 over the transparent front plate 38, as illustrated in FIG. 2. When the magnetic filtering means 22 is again positioned in an operative posture back into the box-like housing 12, the front plate 38 forms part of the front side of the box-like housing 12. The gate handle 36 may now be grasped and pushed forward in order to remove the valve plate 26 from over the top flange opening 16 and to start the magnetic filtering operating again.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A drawer filter comprising in combination a housing means having three solid housing sides and a front side having a front opening, said housing means further including a top flange opening and a bottom flange opening in communication with the top flange opening;

a magnetic filtering means slidably passing through said front opening to slidably lodge within said housing means between said top flange opening and said bottom flange opening; a gate valve means slidably disposed within said housing means between said top flange opening and said magnetic filtering means in order to control the flow of particulate matter through and between said top flange opening and said bottom flange opening, said gate valve means comprising a valve plate means having a generally horizontal planar surface; and at least one rod means secured to said valve plate means and slidably disposed through said housing means and adapted to move said valve plate means.

2. The drawer filter of claim 1 wherein said top flange opening and said bottom flange opening and said magnetic filtering means are in a general aligned relationship with respect to each other in order to filter magnetically any particulate matter, passing through said top flange opening and said bottom flange opening.

3. The drawer filter of claim 1 wherein said magnetic filtering means comprises a front plate means, a back plate means, and a plurality of magnetic cylinder means interconnecting said front plate means with said back plate means.

4. The drawer filter of claim 3 wherein said front plate means and said back plate means are each unitary with no opening or apertures.

5. The drawer filter of claim 4 wherein said plurality of magnetic cylinder means includes at least one magnetic row of magnetic cylinder means and said unitary front plate means with no openings or apertures generally defines part of said housing sides when said magnetic filtering means is disposed within said housing means.

6. The drawer filter of claim 4 wherein said plurality of magnetic cylinder means comprises a first magnetic row of cylinder means and a second magnetic row of cylinder means parallelly disposed with respect to said first magnetic row.

7. The drawer filter of claim 4 wherein said unitary front plate means is transparent.

8. The drawer filter of claim 1 wherein said housing means defines generally a rectangular box-like structure.

9. The drawer filter of claim 1 additionally comprising a particulate feed means supported by said housing means.

10. A drawer filter comprising in combination a housing means having housing sides and a structure defining a top flange means including a top flange opening and a bottom flange means including a bottom flange opening in communication with the top flange opening;

a magnetic filtering means slidably lodged within said housing means between said top flange opening and said bottom flange opening such that said top flange opening and said bottom flange opening and said magnetic filtering means are in a general aligned relationship with respect to each other in order to filter magnetically any particulate matter passing through said top flange opening and said bottom flange opening, said magnetic filtering means comprises a unitary front plate means with no openings or apertures communicating with the atmosphere, a unitary back plate means with no openings or apertures communicating with the atmosphere, and a plurality of magnetic cylinder means interconnecting said unitary front plate means with said unitary back plate means, said plurality of magnetic cylinder means including at least one magnetic row of cylinder means, and said unitary front plate means generally defining part of said housing sides when said magnetic filtering means is disposed within said housing means;

a gate valve means slidably disposed within said housing means between said top flange opening and said magnetic filtering means in order to control the flow of particulate matter through and between said top flange and said bottom flange opening, said gate valve means comprising a valve plate means having a generally horizontal planar surface; and at least one rod means secured to said valve plate means and slidably disposed through said housing means and adapted to move said valve plate means.

11. The drawer filter of claim 10 wherein said plurality of magnetic cylinder means comprises a first magnetic row of cylinder means and a second magnetic row of cylinder means parallelly disposed with respect to said first magnetic row.

12. The drawer filter of claim 10 wherein said housing means defines generally a rectangular box-like structure.

13. The drawer filter of claim 10 wherein said unitary front plate means is transparent.

14. The drawer filter of claim 10 additionally comprising a particulate feed means supported by said housing means.

15. A drawer filter comprising in combination a generally rectangular box-like housing means having housing sides and a structure defining a top flange means including a top flange opening and a bottom flange means including a bottom flange opening in communication with the top flange opening;

a magnetic filtering means slidably lodged within said box-like housing means between said top flange opening and said bottom flange opening such that said top flange opening and said botton flange opening and said magnetic filtering means are in a general aligned relationship with respect to each other in order to filter magnetically any particulate matter passing through said top flange opening and said bottom flange opening, said magnetic filtering means comprising a transparent unitary front plate means with no openings or apertures communicating with the atmosphere, a unitary back plate means with no opening or apertures communicating with the atmosphere, and a plurality of magnetic cylinder means interconnecting said unitary front plate means with said unitary back plate means, said plurality of magnetic cylinder means including a first magnetic row of cylinder means and a second magnetic row of cylinder means parallelly disposed with respect to said first magnetic row, and said transparent unitary front plate means generally defining part of said housing sides when said magnetic filtering means is disposed within said box-like housing means;

a gate valve means slidably disposed within said housing means between said top flange opening and said magnetic filtering means in order to control the flow of particulate matter through and between said top flange opening and said bottom flange opening, said gate valve means comprising a valve plate means having a generally horizontal planar surface; and at least one rod means secured to said valve plate means and slidably disposed through said box-like housing means and adapted to move said valve plate means.

16. The drawer filter of claim 15 additionally comprising a particulate feed means supported by said top flange means.

17. The drawer filter of claim 15 wherein said valve plate means comprises a first pair of generally parallel sides and a second pair of generally parallel sides.

18. The drawer filter of claim 17 comprising a pair of said rod means slidably disposed through said box-like housing means and attached to said first pair of generally parallel sides such that said pair of rod means are oppositely disposed with respect to each other;

one of said second pair of generally parallel sides of said valve plate means terminating into a beveled edge, the remaining side of said second pair of parallel sides having an edge which registers with an end of each of said pair of rod means; and a gate handle means secured to the remaining available end of each of said pair of rod means for slidably moving the gate valve means within said housing means such that the valve plate means obstructs the top flange opening as desired in order to control the flow therethrough.

19. The drawer filter of claim 18 wherein said horizontal planar surface of said valve plate means registers tangentially with said pair of rod means.

* * * * *